US005476609A

United States Patent [19]

Wilkins, Jr. et al.

[11] Patent Number: 5,476,609

[45] Date of Patent: Dec. 19, 1995

[54] ACIDIC CLEANING COMPOSITION FOR REMOVING BURNT STARCH FROM COLD METAL PRESS HEADS

[76] Inventors: William S. Wilkins, Jr., Highway 701 North, Tabor City, N.C. 28463; Robert S. Neuhaus, 6850 Brookvale, San Antonio, Tex. 78238

[21] Appl. No.: 272,813

[22] Filed: Jul. 11, 1994

[51] Int. Cl.[6] ..... C11D 3/60; C11D 3/04; C11D 3/22; C11D 3/44

[52] U.S. Cl. ..... 252/143; 252/142; 252/170; 252/173; 252/174.17; 252/DIG. 14

[58] Field of Search ..... 252/142, 143, 252/170, 174.17, 173, DIG. 14, DIG. 8

[56] References Cited

U.S. PATENT DOCUMENTS

| | | | |
|---|---|---|---|
| 2,186,017 | 1/1940 | Geng | 252/144 |
| 2,337,062 | 12/1943 | Page, Jr. | 252/101 |
| 2,408,155 | 9/1946 | Thornbury | 252/143 |
| 2,477,181 | 7/1949 | Holman | 252/136 |
| 2,493,327 | 1/1950 | Vance | 252/136 |
| 3,494,795 | 2/1970 | Chang | 134/34 |
| 3,865,756 | 2/1975 | Smith | 252/59 |
| 4,469,525 | 9/1984 | Dodge | 252/143 |
| 4,568,395 | 2/1986 | Nabhani | 148/23 |
| 4,608,086 | 8/1986 | Dodge | 252/142 |
| 4,668,421 | 5/1987 | Dollman | 252/136 |
| 4,710,232 | 12/1987 | Tahbaz | 252/158 |
| 4,842,589 | 4/1989 | Magyar et al. | 252/142 |
| 4,855,069 | 8/1989 | Schuppiser et al. | 252/87 |
| 5,207,838 | 5/1993 | Googin et al. | 252/542 |

*Primary Examiner*—Christine Skane
*Assistant Examiner*—A. Hertzog

[57] ABSTRACT

A chemical composition for removing burnt starch from cold metal press heads used in laundries and dry cleaning establishments for pressing starched garments.

4 Claims, No Drawings

ACIDIC CLEANING COMPOSITION FOR REMOVING BURNT STARCH FROM COLD METAL PRESS HEADS

BACKGROUND OF THE INVENTION

This invention relates to a chemical composition for removing burnt starch from cold metal Surfaces, namely, press heads used by dry cleaners and launderers in pressing starched garments.

Typical prior art patents for cleaning metal surfaces include U.S. Pat. Nos. 2,186,017; 2,337,062; 2,408,155; 2,477,181; 2,493,527 and 4,668,421.

SUMMARY OF THE INVENTION it is the primary Object of the invention to provide a viscous chemical composition adapted to remove burnt starch from press heads used by laundries and dry cleaning establishments.

Another object is to provide such a chemical composition which removes burnt starch from press heads which, in normal operation of such equipment, may be transferred to garments being pressed.

A further object is to provide a chemical composition to be applied to cold as opposed to hot press heads, thereby avoiding burns to the user, and which does not abrade or damage said press heads.

Still another object is to provide a chemical composition for removing burnt starch from press heads which is easy to use and relatively inexpensive in cost.

Other objects and features of the invention will become apparent to those skilled in the art from a consideration of the following specification.

PREFERRED EMBODIMENTS OF THE INVENTION

In accordance with the principles of our invention we employ a composition comprising, in specified percentages by weight, hydrofluoric acid, sulfuric acid, an ester such as 2-Butoxyethanol, a nonionic surfactant such as nonylphenol ethoxylate, isopropyl alcohol, a thickening agent such as xanthan gum, and deionized or nonionic water.

Particular preferred compositions according to the present invention that have been found to have excellent properties for removing burnt starch from cold metal press heads, generally composed of stainless steel, cast iron, and Teflon coated aluminum, comprise, on a percent by weight basis, 0.50–5.00 hydrofluoric acid, 0.50–4.95 sulfuric acid, 0.10–4.00 2-Butoxyethanol, 0.10–4.00 petroleum distillate, 0.10–2.00 nonionic surfactant such as nonylphenol ethoxylate, 0.10–1.00 isopropyl alcohol, 0.10–0.80 thickening agent such as xanthan gum, and the remainder of deionized or nonionic water.

EXAMPLE I

| | Percent by weight |
|---|---|
| Hydrofluoric acid | 0.50–5.00 |
| Sulfuric acid | 0.50–4.95 |
| Ethylene glycol monobutyl ether | 0.10–4.00 |
| Petroleum distillate | 0.10–4.00 |
| Nonionic surfactant | 0.10–2.00 |

-continued

| | Percent by weight |
|---|---|
| Isopropyl alcohol | 0.10–1.00 |
| Thickening agent | 0.10–0.80 |
| Deionized water | Reminder |

The pH of such formulations range from 2.3 to 3.0; the optimum is a pH of 2.7.

EXAMPLE II

| | Percent by weight |
|---|---|
| Hydrofluoric acid | 1.1760 |
| Sulfuric acid | 1.1625 |
| 2-Butoxyethanol | 1.25 |
| Aliphatic hydrocarbon | 1.45 |
| Nonylphenol ethoxylate | 0.50 |
| Isopropanol | 0.20 |
| Xanthan gum | 0.60 |
| Deionized water | 93.6615 |

The petroleum distillate specified in Example II is an aliphatic hydrocarbon, preferably of the Stoddard type, such as is well known in the art.

EXAMPLE III

| | Percent by weight |
|---|---|
| Hydrofluoric acid | 0.80 |
| Sulfuric acid | 0.70 |
| 2-Butoxyethanol | 1.00 |
| Aliphatic hydrocarbon | 0.25 |
| Nonylphenol ethoxylate | 0.20 |
| Isopropanol | 0.10 |
| Xanthan gum | 0.25 |
| Delonized water | Remainder |

EXAMPLE IV

| | Percent by weight |
|---|---|
| Hydrofluoric acid | 3.50 |
| Sulfuric acid | 3.40 |
| 2-Butoxyethanol | 3.75 |
| Nonylphenol ethoxylate | 1.90 |
| Aliphatic hydrocarbon | 3.75 |
| Isopropanol | 0.80 |
| Xanthan gum | 0.70 |
| Deionized water | 82.20 |

In formulating the composition of Example I of the subject invention, for example, each of the constituents in the range heretofore specified are introduced into a vat or the like. Deionized or nonionic water is metered into said vat and the thickening agent introduced and thoroughly blended; sulfuric acid is then added. Ethylene glycol monobutyl ether and the petroleum distillate are mixed in a second container and introduced into said vat. The nonionic surfactant, isopropyl alcohol, and hydrofluoric acid are then added to the vat and thoroughly mixed, after which such formulation is packaged.

In use, one application of the burnt starch remover of the subject invention is applied to a cold press head, composed of stainless steel, cast iron, or Teflon coated aluminum, such as are normally used in laundries and dry cleaning establishments for pressing starched garments.

The user, desirably wearing protective gloves, applies a liberal amount of the viscous composition to a cloth pad or sponge and wipes the entire head of the press; after approximately thirty seconds to one minute the press head is wiped with a clean, damp cloth, removing the brownish-colored accumulation of starch therefrom. If required, a second application removes any starch residue. Rinsing of the press head with water and drying are required. If such burnt starch is not periodically removed, the accumulation of starch is transferred to the garment being pressed.

It should be understood, of course, that the foregoing disclosure relates to only preferred embodiments of the invention and that it is intended to cover all changes and modifications of the formulations herein chosen for the disclosure which do not constitute departures from the spirit and scope of the invention.

What is claimed is:

1. A chemical composition comprising hydrofluoric acid in the range of 0.50 to 5.00 percent by weight, sulfuric acid in the range of 0.50 to 4.95 percent by weight, ethylene glycol monobutyl ether in the range of 0.10 to 4.00 percent by weight, petroleum distillate in the range of 0.10 to 4.00 percent by weight, a nonionic surfactant in the range of 0.10 to 2.00 percent by weight, isopropyl alcohol in the range of 0.10 to 1.00 percent by weight, a thickening agent in the range of 0.10 to 0.80 percent by weight, and the remainder deionized water.

2. A chemical composition comprising hydrofluoric acid 1.1760 percent by weight, sulfuric acid 1.1625 percent by weight, 2-Butoxyethanol 1.25 percent by weight, an aliphatic hydrocarbon 1.45 percent by weight, nonylphenol ethoxylate 0.50 percent by weight, isopropanol 0.20 percent by weight, xanthan gum 0.60 percent by weight, and the remainder deionized water.

3. A chemical composition comprising hydrofluoric acid 0.80 percent by weight, sulfuric acid 0.70 percent by weight, 2-Butoxyethanol 1.00 percent by weight, an aliphatic hydrocarbon 0.25 percent by weight, nonylphenol ethoxylate 0.20 percent by weight, isopropanol 0.10 percent by weight, xanthan gum 0.25 percent by weight, and the remainder deionized water.

4. A chemical composition comprising hydrofluoric acid 3.50 percent by weight, sulfuric acid 3.40 percent by weight, 2-Butoxyethanol 3.75 percent by weight, nonylphenol ethoxylate 1.90 percent by weight, an aliphatic hydrocarbon 3.75 percent by weight, isopropanol 0.80 percent by weight, xanthan gum 0.70 percent by weight, and deionized water 82.20 percent by weight.

* * * * *